US005942711A

United States Patent [19]

Tanji

[11] Patent Number: 5,942,711

[45] Date of Patent: Aug. 24, 1999

[54] ROLL-SOUND PERFORMANCE DEVICE AND METHOD

[75] Inventor: Ryoji Tanji, Hamamatsu, Japan

[73] Assignee: Yamaha Corporation, Hamamatsu, Japan

[21] Appl. No.: 09/079,673

[22] Filed: May 15, 1998

[30] Foreign Application Priority Data

May 20, 1997 [JP] Japan ..... 9-145840

[51] Int. Cl.[6] ..... G10H 1/40

[52] U.S. Cl. ..... 84/651; 84/652; 84/743

[58] Field of Search ..... 84/612, 622, 636, 84/652, 659, 668, 743, 611, 635, 651, 730

[56] References Cited

U.S. PATENT DOCUMENTS 5,288,938 2/1994 Wehaton ..... 84/743 X
5,350,882 9/1994 Koguchi et al. ..... 84/612 X
5,399,801 3/1995 Hasebe et al. .
5,610,355 3/1997 Hasebe et al. ..... 84/743

FOREIGN PATENT DOCUMENTS 61-78241 4/1986 Japan .
3-124139 5/1991 Japan .

*Primary Examiner*—Jeffrey W. Donels
*Attorney, Agent, or Firm*—Graham & James LLP

[57] ABSTRACT

A unique note length is allocated to each of a plurality of operating positions provided on a ribbon controller. In response to a position-selecting operation by a human operator, time data is generated which is representative of the note length allocated to the selected operating position. An automatic drum roll performance is executed by repetitively generating a drum sound with a note length represented by the thus-generated time data.

11 Claims, 5 Drawing Sheets

ROLL-SOUND PERFORMANCE DEVICE AND METHOD

BACKGROUND OF THE INVENTION

The present invention relates to a tone-generation timing control device and method capable of controlling, as intended by a human operator, generation timing of each sound to be automatically performed by an automatic performance device. In other words, the present invention relates to an automatic roll-sound performance device and method.

Automatic performance devices have been extensively known and used today, in which various performance information, such as note data relating to individual notes of melody and accompaniment performances, are prestored in memory and the prestored performance information is automatically read out from the memory at a predetermined tempo to generate melody, accompaniment and rhythm sounds in accordance with the read-out performance information. In these automatic performance devices, the performance tempo is determined by a frequency of tempo clock pulses output from a timer or the like. The performance tempo of an entire music piece can be varied optionally by varying the tempo clock frequency such as via a tempo setting switch.

In performing or audibly generating rhythm sounds, such as percussive sounds, a style of rendition called "roll" is often employed which generates rhythm sounds successively at equal short time intervals. Further, there have been known two main schemes for preparing (sounding) a rhythm with such a roll effect: the "real-time input" scheme where tone data are prepared in accordance with an actual performance by a human player or operator; and the "step-time input" scheme where tone data are prepared by entry of numerical values.

In the real-time input scheme, precision of tone data to be prepared depends greatly on the performance ability or skill of the player. Thus, it is extremely difficult to prepare tone data of rhythm sounds with a roll effect which are to be sounded at very short time intervals and hence very difficult for a human player to perform. In such a case, the rhythm sounds with a roll effect which are to be sounded at very short time intervals can be generated relatively easily by first executing an actual performance at a slower tempo for the purpose of recording tone data of the performance and then reproducing the recorded tone data at a normal tempo.

In the step-time input scheme, tone data of rhythm sounds corresponding to a desired roll effect are prepared merely by entering numerical values such that the rhythm sounds are generated at desired time intervals. Degree of the roll effect can be checked by actually reproducing the prepared tone data.

However, in the case where the real-time input scheme is used to prepare tone data of rhythm sounds with a roll effect, then a series of troublesome tone data creating operations has to be repeated if the prepared tone data are not exactly as desired. In the case where the step-time input scheme is used, a multiplicity of tone data with equal intervals have to be prepared taking a long entry time, and besides the rhythm sounds can not be verified during preparation of the tone data.

SUMMARY OF THE INVENTION

It is therefore an object of the present invention to provide a sound performance device and method which greatly facilitate preparation and generation of rhythm sounds occurring at short intervals such as drum-roll sounds.

In order to accomplish the above-mentioned object, the present invention provides a sound performance device which comprises: a performance operator unit having a plurality of operating positions to each of which is allocated a unique unit time, the performance operator unit, in response to selection of any one of the operating positions by a human operator, generating time data representative of the unit time allocated to the one operating position; and a control unit that executes control to repetitively generate a sound of given tone color at intervals of the unit time represented by the time data generated by the performance operator unit.

In the sound performance device, the given tone color may be selected from among a plurality of drum-instrument tone colors, so that a rapid succession of drum roll sounds can be generated automatically. Further, the unit times allocated to the operating positions correspond to various note lengths. In addition, the performance operator unit outputs the time data while the human operator executes a predetermined performance operation, and the control unit executes the control to repetitively generate a sound of given color while the time data is outputted by the performance operator unit.

Thus, the human operator can automatically execute a drum roll performance based on a desired unit note length, by just selecting the desired unit note length through simple activation (e.g., a single depression) of the corresponding operating position on the performance operator unit. Namely, control is executed to generate time data representative of the unit time allocated to the selected operating position and to repetitively generate a sound of given tone color at intervals of the unit time corresponding to the thus-generated time data. As a consequence, a drum roll performance is carried out in an automatic manner. Accordingly, it is not necessary for the human operator to conduct troublesome entry of step time data and actual roll-drumming operation requiring a considerable skill.

The present invention can be arranged and implemented as a method as well as a device. The present invention can also be practiced as a computer program and as a recording medium containing such a computer program.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 2:
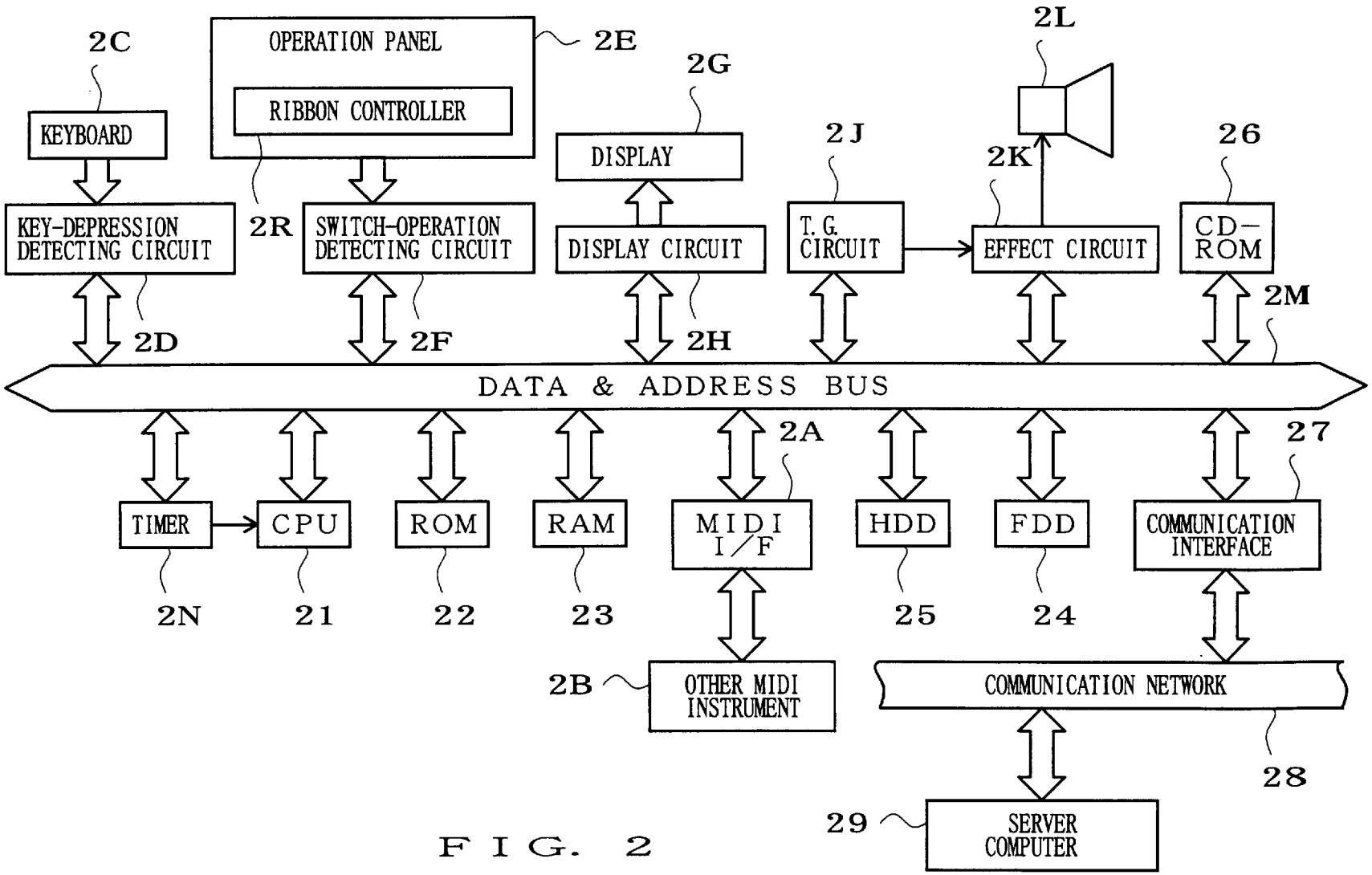
FIG. 2 is a block diagram illustrating a general hardware setup of an electronic musical instrument with an automatic performance function containing a tone-generation timing control device in accordance with a preferred embodiment of the present invention.

FIG. 2 is a block diagram illustrating a general hardware setup of an electronic musical instrument having an automatic performance function and containing tone-generation timing control device in accordance with a preferred embodiment of the present invention.

In FIG. 2, a microprocessor unit (CPU) 21 controls overall operations of the electronic musical instrument on the basis of various programs and data stored in a ROM 22 and RAM 23 as well as tone control information (MIDI data) received from an external storage device. To the CPU 21 are connected various elements via a data and address bus 2M.

Whereas the preferred embodiment will be described hereinbelow in relation to an example where the external storage device includes a floppy disk drive (FDD) 24, a hard disk drive (HDD) 25 and a CD-ROM drive 26, the external storage device may further include an magneto-optical disk (MO) drive and/or a PD (Phase change Disk) drive. Further, various information including tone control information may be received from a server computer 29 or the like on a connected communication network 28 via a communication network 27, and/or MIDI data or the like may be received from another MIDI instrument 2B via a MIDI interface 2A.

The CPU 21 also supplies a tone generator (T.G.) circuit 2J with MIDI data received from the external storage device or generated in response to key depressing operation on a keyboard 2C by a human player or operator so that the tone generator circuit 2J generates a sound on the basis of the supplied MIDI data. Alternatively, tone generation processing may be executed by use of an external tone generator.

The ROM 22, which is a read-only memory (ROM), has prestored therein various programs (including system and operating programs) and various data. The RAM 23, which is for temporarily storing d at a generated as the CPU 21 executes a program, is provided in predetermined address regions of a random access memory (RAM) and used as registers, flags, buffers, tables, etc.

Further, although not specifically shown, the operating program may be stored in the external storage device such as the hard disk device 25. By storing the operating program in the hard disk device 25 rather than in the ROM 22 and loading the operating program into the RAM 23, the CPU 21 can operate in exactly the same way as where the operating program is stored in the ROM 22. This arrangement greatly facilitates version-up of the operating program, addition of a new operating program, etc. A CD-ROM disk may be used as a removably-attachable external recording medium for recording various data, such as automatic performance data, chord progression data, tone waveform data and image data, and an optional operating program. Such an operating program and data stored in the CD-ROM disk can be read out by the CD-ROM drive 26 to be then transferred for storage in the hard disk device 25. This arrangement also facilitates installation and version-up of the operating program.

The communication interface 27 may be connected to the data and address bus 2M of the electronic musical instrument so that the instrument can be connected via the interface 27 to a desired communication network such as a LAN (Local Area Network), Internet or telephone network to exchange data with the sever computer 29. Thus, in a situation where the operating program and various data are not contained in the hard disk device 25, these operating program and data can be downloaded from the server computer 29. In such a case, the electronic musical instrument, which is a "client" tone generating or automatic performance device, sends a command requesting the server computer 29 to download the operating program and various data by way of the communication interface 27 and communication network 28. In response to the command, the server computer 29 delivers the requested operating program and data to the automatic performance device via the communication network 28. The automatic performance device receives the operating program and data via the communication interface 27 and accumulatively store them into the hard disk device 25. In this way, the necessary downloading of the operating program and various data is completed.

The keyboard 2C, which is connected to a key-depression detecting circuit 2D, has a plurality of keys for designating a pitch of each sound to be generated and key switches provided in corresponding relations to the keys. Depending on an application intended, the keyboard 2C may also include a key-touch detecting means such as a key-depression velocity (or force) detecting device. Any other performance operator may be employed in the automatic performance device in place of or in addition to the keyboard 2C, although the automatic performance device will be described here as employing the keyboard 2C since the keyboard is a fundamental performance operator easy to understand.

The key-depression detecting circuit 2D, which comprises a plurality of key switch circuits corresponding to the keys on the keyboard 2C, outputs a key-on event signal upon detection of each newly depressed key and a key-off event signal upon detection of each newly released key, as well as note numbers indicative of pitches of the keys where the key-on and key-off events have occurred. The key-depression detecting circuit 2D also generates velocity data and after-touch data by determining a key-depression velocity or force.

Operation panel 2E is connected to a switch-operation detecting circuit 2F which detects operational states of various switches and operators on the operation panel 2E to output switch event signals corresponding to the detected states to the CPU 21 via the data and address bus 2M.

Specifically, on the operation panel 2E, there are provided an automatic performance start/stop switch, a pause switch and various other switches and operators for selecting, setting and controlling a color (timbre), volume, effect, etc. of a sound to be generated; however, in the figure and following description, only a ribbon controller 2R for setting generation start timing of sounds with a roll effect is shown and described because the other switches are not part of the present invention and well known in the art.

Figure 1A:
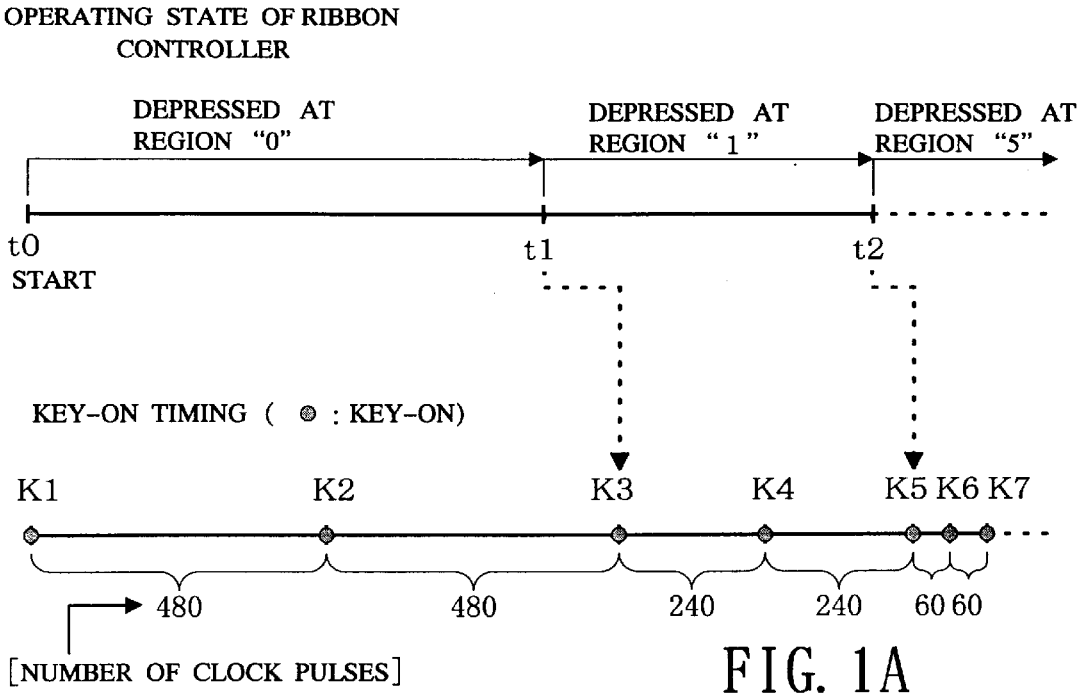
FIGS. 1A and 1B are diagrams showing how key-on timing varies in response to operating states of a ribbon controller in the present invention and the general structure of the ribbon controller.
Figure 1B:
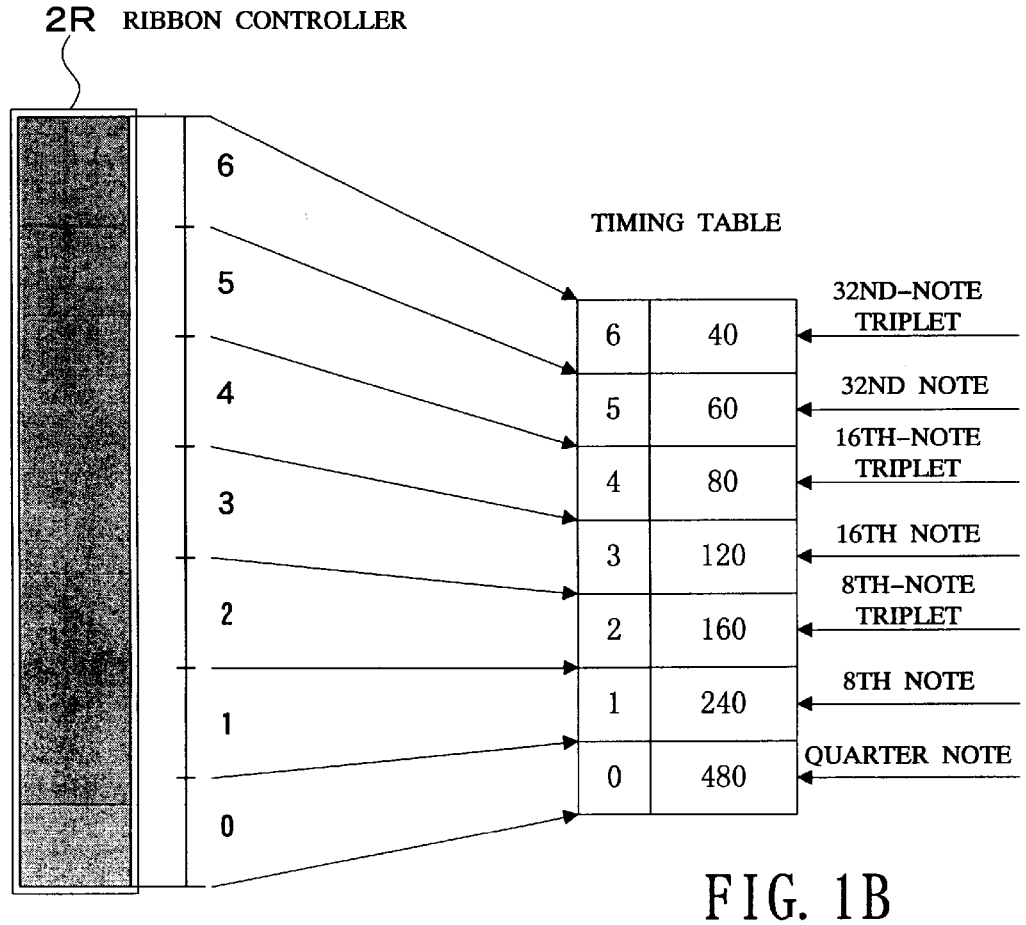

FIG. 1B outlines the structure of the ribbon controller 2R, which has a rectangular band-like shape and outputs a region signal corresponding to a particular position where a human operator has depressed the rectangular ribbon controller 2R. In the illustrated example of FIG. 1B, the rectangular ribbon controller 2R has seven regions to each of which is allocated unique step time data to achieve a roll effect. More specifically, as the step time data, a value "480" corresponding to a quarter note is allocated to region "0", a value "240" corresponding to an eighth note is allocated to region "1", a value "160" corresponding to an eighth-note triplet is allocated to region "2", a value "120" corresponding to a sixteenth note is allocated to region "3", a value "80" corresponding to a sixteenth-note triplet is allocated to region "4", a value "60" corresponding to a thirty-second note is allocated to region "5", and a value "40" corresponding to a thirty-second-note triplet is allocated to region "6". These step time data values are calculated on the assumption that one clock pulse represents 1/480 of a quarter note length, and will be varied if the assumption is altered. As described above, the "step time data" is time data indicative of a length of each unit note constituting a roll performance.

Display circuit 2H controls the display 2G to show various information such as controlling states of the CPU 21 and currently set data. The display 2G may be a liquid crystal display (LCD) or any other suitable display.

Figure 3:
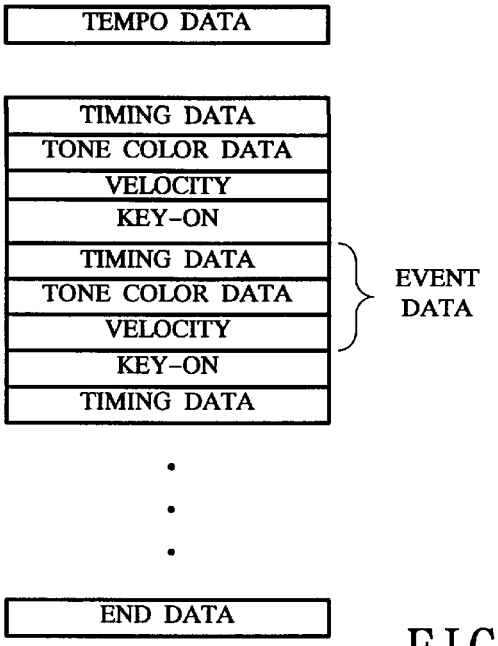
FIG. 3 is a diagram showing an example data organization of rhythm-related tone control information which is processed by the electronic musical instrument of FIG. 2.

The tone generator circuit 2J is capable of simultaneously generating tone signals in a plurality of channels on the basis of tone control information (MIDI data) given from the CPU 21. FIG. 3 is a diagram showing an example data organization of rhythm-related tone control information, which includes tempo data, timing data and event data (tone color data, velocity data and key-on data). The tempo data serves to determine an automatic performance tempo. The timing data is indicative of a time interval between successive events and also called duration time; if the timing data is "0", it means that two events are sounded at the same timing. The event data includes tone color data indicative of a color or timbre of a tone to be generated, velocity data indicative of a volume of a tone to be generated, and key-on data indicative of a particular sort of the event in question. Because percussive sounds for use in a rhythm performance are normally of decaying nature and diminish in volume over time to mute, no key-off signal is required of the rhythm-related tone control information and key-off data as found in normal automatic performance data will not be described here.

The tone generation channels to simultaneously generate tone signals in the tone generator circuit 2J may be implemented by using a single circuit on a time-divisional basis or by providing a separate circuit for each of the channels. Any known tone signal generation method may be used in the tone generator circuit 2J depending on an application intended. For example, any conventionally known tone signal generation method may be used such as: the memory readout (waveform memory) method where tone waveform sample value data stored in a waveform memory are sequentially read out in accordance with address data that vary in accordance with a pitch of a tone to be generated; the FM method where tone waveform sample value data are obtained by performing predetermined frequency modulation operations using the above-mentioned address data as phase angle parameter data; or the AM method where tone waveform sample value data are obtained by performing predetermined amplitude modulation operations using the above-mentioned address data as phase angle parameter data. Other than the above-mentioned, the tone generator circuit 2J may also use the physical model method where a tone waveform is synthesized by algorithms simulating a tone generation principle of a natural musical instrument; the harmonics synthesis method where a tone waveform is synthesized by adding a plurality of harmonics to a fundamental wave; the formant synthesis method where a tone waveform is synthesized by use of a formant waveform having a specific spectral distribution; or the analog synthesizer method using VCO, VCF and VCA. Further, the tone generator circuit 2J may be implemented by a combined use of a DSP and microprograms or of a CPU and software programs, rather than by use of dedicated hardware.

Timer 2N generates tempo clock pulses for counting a time interval and setting an automatic performance tempo. The frequency of the tempo clock pulses may be set via the tempo setting switch on the operation panel 2E or on the basis of the tempo data previously included in the performance data as shown in FIG. 3. Each tempo clock pulse generated by the timer 2N is fed to the CPU 21 as an interrupt instruction, in response to which the CPU 21 interruptively carries out various operations necessary for an automatic performance. The current preferred embodiment will be described hereinbelow on the assumption that the tempo clock pulses are generated at a frequency of 480 times per quarter note.

Effect circuit 2K imparts various effects to tone signals generated by the tone generator circuit 2J and supplies the effect-imparted tone signals to a sound system 2L, which audibly reproduces or sounds them via amplifiers and speakers.

FIG. 1A is a diagram showing how key-on timing varies in response to operating states of the ribbon controller 2R of FIG. 1B. Specifically, FIG. 1A shows how key-on timing varies as regions "0", "1" and "5" of the ribbon controller 2R are depressed sequentially in periods from time t0 to t1, from time t1 to t2 and at and after time t2, respectively.

When the ribbon controller 2R is depressed in the current embodiment, the tone generation processing is carried out at key-on timing corresponding to the step time data in the timing table of FIG. 1B, irrespective of the timing data included in the rhythm data of FIG. 3. Further, even when the depressed position on the ribbon controller 2R changes at time t1, the key-on timing remains unchanged at time t1; instead, tone generation processing corresponding to depression on region "1" is initiated at key-on timing K3 when the entire step time of the last-generated sound has completely elapsed.

Next, a description will be given about exemplary operations to be executed in response to player's operation of the ribbon controller 2R, with reference to FIGS. 4 to 6. Only operations relating to the roll effect will be described in detail below, and the other operations will be described briefly.

Figure 4:
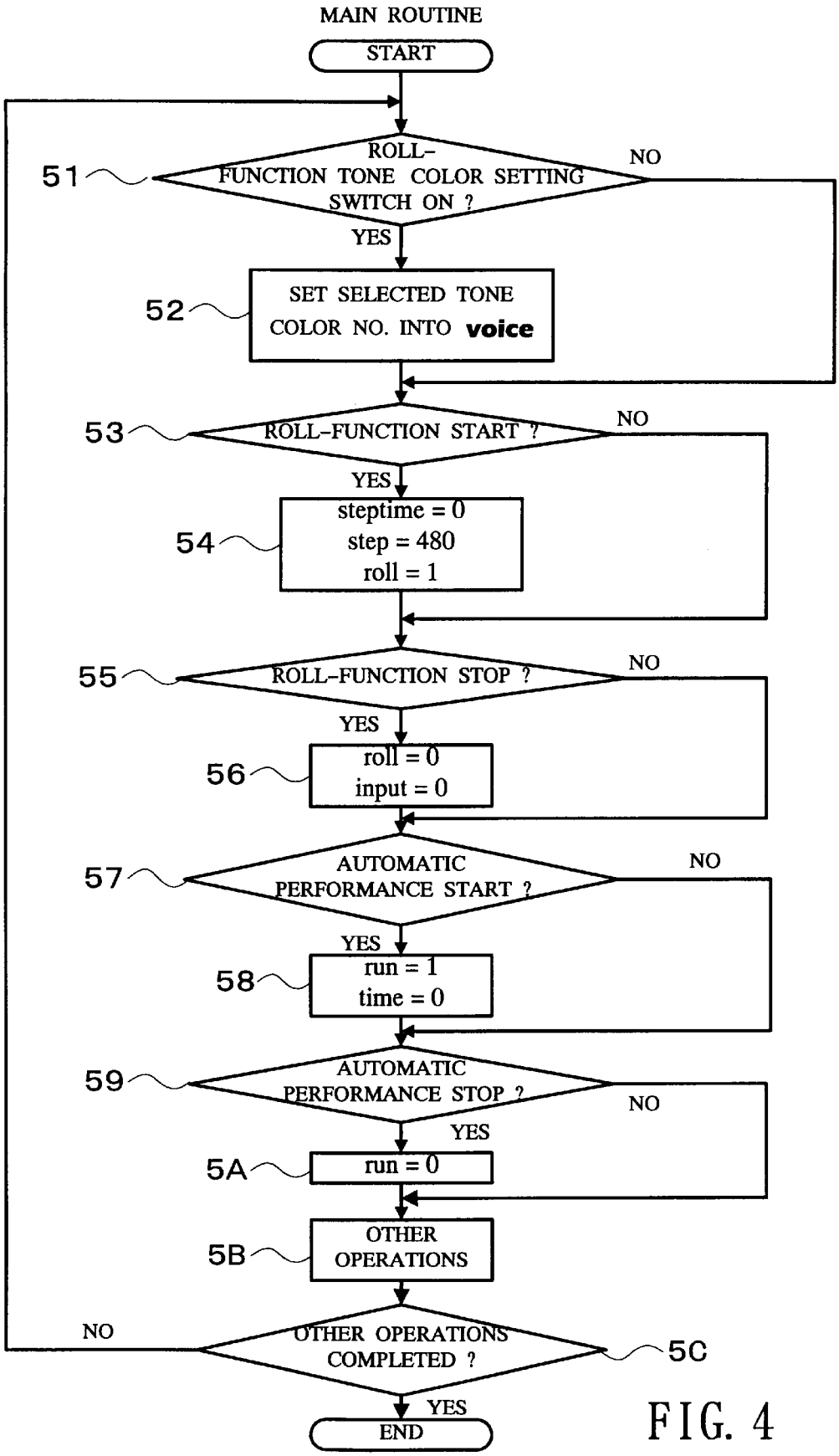
FIG. 4 is a flow chart of an example main routine that is carried out by the electronic musical instrument of FIG. 2.

FIG. 4 is a flow chart of an example main routine that is carried out by the electronic musical instrument of FIG. 2. First, at step 51, a determination is made as to whether a roll-function tone color setting switch (not shown) on the operation panel 2E has been operated or turned on to set a roll-function tone color. If an affirmative (YES) determination is made at step 51, the main routine proceeds to step 52; otherwise, the main routine jumps to step 53. At step 52, a selected tone color number is set into a voice register ("voice"). Then, a sound of the color number thus set in the voice register VOICE will be audibly generated by the roll function; if automatic performance data being sounded contain a sound of the same tone color as represented by the tone color number, then the electronic musical instrument operates to not generate that sound.

At step 53, it is determined whether a roll-function start switch (not shown) has been operated on the operation panel 2E, and a further determination is made at step 55 as to whether a roll-function stop switch (not shown) has been operated. At step 54, a value "0" is set into a step time counter ("steptime") that counts a step time in the roll function in response to the operation of the roll-function start switch, a maximum value "480" of step time data is set into a step time register ("step") that indicates a step time for the currently-set roll effect, and a value "1" is set into a roll function flag ("roll"). Sine the maximum value of the step time data is "480" in the present embodiment, the value "480" is stored into the step time counter. At step 56 following step 55, the roll function flag ("roll") and an input state flag ("input") are each set to "0". The roll function flag indicates whether or not the current mode is a roll process mode; when the roll function flag is at "1", it indicates that the current mode is the roll process mode, while when the roll function flag is at "0", it indicates that the current mode is other than the roll process mode.

At step 57, a determination is made as to whether an automatic performance start switch (not shown) has been operated on the operation panel 2E. At step 59, a further determination is made as to whether an automatic performance stop switch (not shown) has been operated on the operation panel 2E. At step 58 taken in response to an affirmative determination at step 57, a value "1" is set into a running state flag ("run") and "0" is set into a timing counter ("time") indicating automatic-performance progression timing, in response to the operation of the automatic performance start switch. At step 5A taken in response to an affirmative determination at step 59, the running state flag is set to "0" in response to the operation of the automatic performance stop switch. Namely, when the running state flag ("run") is at "1", it indicates that the current mode is an automatic performance process mode, while when the running state flag is at "0", it indicates that the current mode is other than the automatic performance process mode.

At step 5B following step 5A, other necessary operations for the electronic musical instrument are carried out. Subsequently, it is determined at step 5C whether or not all the necessary operations have been completed for the electronic musical instrument; if answered in the negative, the above-mentioned operations of steps 51 to 5B are repeated until all the necessary operations have been completed.

Figure 5:
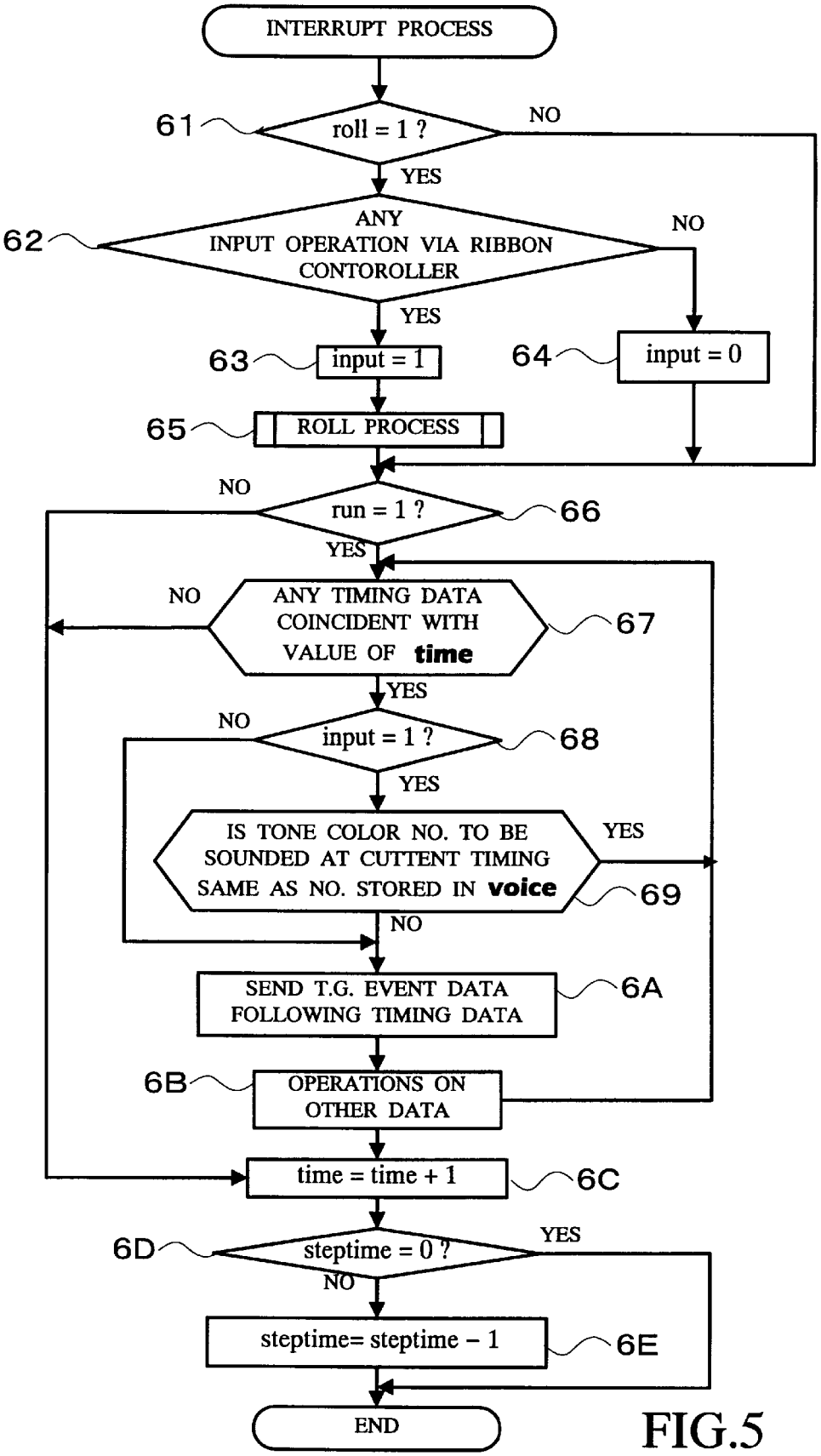
FIG. 5 is a flow chart of a timer interrupt process that is carried out by the electronic musical instrument of FIG. 2 in synchronism with clock pulses.

FIG. 5 is a flow chart showing an example of a timer interrupt process that is carried out in response to each of the interrupt clock pulses from the timer 2N occurring 480 times per quarter note as mentioned above. First, at step 61, a determination is made as to whether the roll function flag is at "1". If answered in the affirmative, it is further determined at step 62 whether any input operation has been executed via the ribbon controller 2R. For example, if a depression force value contained in a depression signal from the ribbon controller 2R is greater than a predetermined value, "1" is set into the input state flag at step 63, judging that the ribbon controller 2R is being currently operated; in this case, the roll process is carried out at step 65 as will be described in detail in relation to FIG. 6. If, on the other hand, the depression force value is not greater than the predetermined value, "0" is set into the input state flag at step 64, judging that the ribbon controller 2R is not being currently operated.

Figure 6:
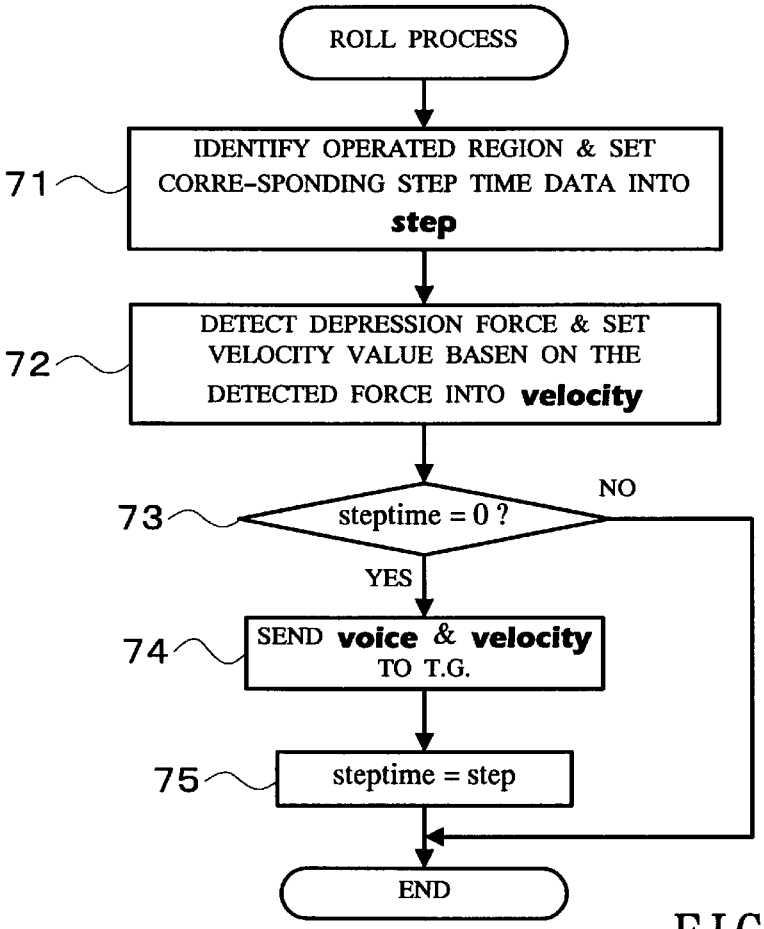
FIG. 6 is a flow chart illustrating details of a roll process of FIG. 5.

At first step 71 in the roll process of FIG. 6, the region number of one of the regions operated on the ribbon controller 2R is identified, and the step time data in the timing table corresponding to the identified region is set into the step time register ("step"). At next step 72, the depression force exerted on the region is detected, and a velocity value based on the detected depression force is set into a velocity register ("velocity").

Then, at step 73, a determination is made as to whether or not the current count of the step time counter is "0". If the current count of the step time counter is "0" as determined at step 73, control goes to step 74 in order to send the tone generator circuit 2J the tone color number stored in the voice register, velocity value stored in the velocity register and a key-on signal. At step 75 following step 74, the value currently stored in the step time register is set into the step time counter. By thus executing the operations of steps 74 and 75 only after the step time counter has reached "0", even though there occurs a change in the depressed position on the ribbon controller 2R at time t1 as shown in FIG. 1A, the tone generation processing corresponding to the new depressed position (region "1") is initiated at key-on timing K3 when a series of the operations has been completed, without the key-on timing changing at time t1. In this way, rhythm sounds with a roll effect can be generated without impairing the rhythm.

At step 66, it is ascertained whether the running state flag is at "1" (run=1), i.e., whether an automatic performance is currently in progress. If an automatic performance is currently in progress, control proceeds to step 67 in order to carry out operations at and after step 67, but if not, control jumps to step 6C. Thus, a predetermined roll process is executed simultaneously with automatic generation of tones while an automatic performance is in progress, but only the roll process is executed while an automatic performance is not in progress.

If the tone color sounded by the automatic performance process is identical with the one sounded by the roll process, these steps 67 to 6A work to not effect the sounding based on the automatic performance process, giving priority to the sounding based on the roll process. As a consequence, it is possible to avoid the inconvenience that two rhythm sounds of a same tone color are generated simultaneously.

Namely, at step 67, it is ascertained whether or not there exits any timing data coincident with the current count of the timing counter ("time"). If answered in the affirmative, control proceeds to step 68, where a further determination is made as to whether the input state flag ("input") is at "1", i.e., whether the ribbon controller 2R is being currently depressed. If the ribbon controller 2R is being currently depressed as determined at step 68 (YES), it is further ascertained at next step 69 whether the color number of a sound to be automatically generated at this timing is the same as the color number currently stored in the voice register ("voice"). If the two tone color numbers coincide with each other, control moves on to next step 6A, but if not, control jumps to step 6B. Step 6A sends the tone generator circuit 2J event data following the time data, and step 6B carries out operations on other data.

At step 6C, the timing counter is incremented by one. At next step 6D, it is determined whether the step time counter ("steptime") has reached "0". With a negative determination, the step time counter is decremented by one at step 6E, but with an affirmative determination, the interrupt process is brought to an end to wait for arrival of next interrupt timing.

In the above-describe embodiment, no particular key-off signal is sent to the tone generator because the embodiment works on rhythm data representative of rhythm sounds having a decaying nature. Thus, where the roll process of the invention is carried out on other tone data than the rhythm data, key-off signals may be sent to the tone generator; in such a case, gate time (tone-generation lasting time) data may be added to event data so that a key-off signal is issued to the tone generator in accordance with the gate time.

Further, whereas the above-describe embodiment uses, as one clock pulse, 1/480 of the time corresponding to a quarter note, any other clock pulse generation timing may be employed.

Furthermore, whereas the embodiment has been described above as updating the sound generation intervals in synchronism with the end point of each current tone generation interval, the sound generation intervals may be changed at each time point when the ribbon controller is operated.

Furthermore, whereas in the above-described embodiment the ribbon controller is divided into six operating positions or regions and unique step time data is allocated to each of the regions, the ribbon controller may be divided into less than or more than six regions. Also, the above-mentioned step time data are only exemplary and any other step time data may be allocated, and additional arrangements may be made to allow the player or human operator to optionally decide which step time data should be allocated to which region.

Furthermore, whereas the embodiment has been described and flowcharted only in relation to generation of sounds, actually performed data may of course be stored in memory.

Furthermore, the embodiment ha s been described above as detecting depression force exerted on the ribbon controller and setting the intensity value of the detected depression force as a tone generating velocity. However, in the case of a cheaper ribbon controller with no depression function, a table representing velocity variations may be provided such that a velocity change is effected on the basis of the stored data in the table. It should be obvious that the velocity may be changed in accordance with the detected depression force.

As another modification, the ribbon controller may be replaced with a keyboard divided into a plurality of key ranges, of which the low key range may be used to provide the desired roll function; in this case, a step time is allocated to each of the keys.

Whereas the preferred embodiment has been described as being an electronic musical instrument, the present invention may be embodied as an automatic performance system implemented by a personal computer running application software. In this case, the application software may be prestored on any recording medium, such as a magnetic disk, optical disk and semiconductor memory, and supplied to the personal computer directly or via a communication network.

Further, any other type of electronic musical instrument than the keyboard-type instrument, such as a stringed instrument, wind instrument or percussion instrument, may be employed, in the case where the present invention is applied to an electronic musical instrument.

Furthermore, the above-described tone generator may be applied to an electronic musical instrument where a tone generator module and sequencer provided separately from each other are connected such as via MIDI and/or network communication means, rather than the integrated-type electronic musical instrument containing a tone generator and automatic accompaniment.

Note that detailed description of automatic performance and automatic accompaniment processes is omitted here because they are well known in the art.

Although not specifically stated, the performance data used in the present invention may be in any desired format such as: the "event plus relative time" format where an occurrence time of each performance event is expressed by an elapsed time from a preceding event; the "event plus absolute time" format where an occurrence time of each performance event is expressed by an absolute time within a music piece or measure; the "pitch (rest) plus note length" format where performance data is expressed by a combination of pitch and length of a note or by a combination of rest and its length; and the so-called "solid" format where a memory location is allocated for each minimum resolution unit of a performance and each performance event is stored at one of the memory locations corresponding to an occurrence time of the event.

Furthermore, the automatic performance tempo may be changed in any desired manner; for example, it may be changed by varying a tempo clock (interrupt signal) frequency, modifying a timing data value while maintaining a constant tempo clock frequency or varying a value used to count timing data per operation.

Moreover, the accompaniment pattern data may be in a format where data for a plurality of channels are stored together in a mixed condition or in a format where data for each channel is stored in a separate track.

With the arrangements having been described so far, the present invention affords the superior benefit that rhythm sounds occurring successively at short intervals, such as a rapid succession of drum roll sounds, can be easily generated in response to a real-time performance operation.

What is claimed is:

1. A sound performance device comprising:

a performance operator unit having a plurality of operating positions to each of which is allocated a unique unit time, said performance operator unit, in response to selection of any one of the operating positions by a human operator, generating time data representative of the unit time allocated to the one operating position; and a control unit that executes control to repetitively generate a sound of a given tone color at intervals of the unit time represented by the time data generated by said performance operator unit.

2. A sound performance device as recited in claim 1 wherein said given tone color is selected from among a plurality of drum-instrument tone colors, whereby a succession of drum roll sounds can be generated automatically.

3. A sound performance device as recited in claim 1 wherein the unit times allocated to the operating positions correspond to various note lengths.

4. A sound performance device as recited in claim 1 wherein said performance operator unit outputs the time data while the human operator executes a predetermined performance operation, and said control unit executes said control to repetitively generate a sound of given color while the time data is outputted by said performance operator unit.

5. A sound performance device as recited in claim 4 wherein the unit times allocated to the operating positions correspond to various note lengths, and wherein when there occurs a switch in the time data generated by said performance operator unit, said control unit executes control such that a predetermined time point for changing a time interval between the repetitively generated sounds, from the time interval corresponding to a preceding note length to the time interval corresponding to a succeeding note length, is synchronized to an end of the preceding note length.

6. A sound performance device as recited in claim 1 wherein said control unit generates performance event information to repetitively generate a sound of a given tone color at intervals of the unit time represented by the time data generated by said performance operator unit.

7. A sound performance device as recited in claim 1 which further comprises an automatic performance device and wherein when the sound of given tone color is repetitively generated by said control unit, said automatic performance device prevents an automatic performance sound of the same tone color as the given tone color from being generated thereby.

8. A sound performance device as recited in claim 1 wherein said performance operator unit comprises a ribbon controller having a band-shaped operating section divided into a plurality of operating ranges corresponding to the operating positions, and said ribbon controller detects which of the operating ranges is depressed by the human operator.

9. A sound performance device as recited in claim 1 wherein said performance operator unit comprises a keyboard and each of the operating positions corresponds to one or more keys on the keyboard.

10. A method of automatically executing a drum roll performance comprising the steps of:

providing a performance operator unit having a plurality of operating positions to each of which is allocated a unique unit time;

in response to selection of any one of the operating positions by a human operator, generating time data representative of the unit time allocated to the one operating position; and repetitively generating sound-generation instructing information of a given drum tone color at intervals of the unit time represented by the time data generated by said performance operator unit to thereby execute a drum roll.

11. A machine-readable recording medium containing a program for automatically executing a drum roll performance by use of a performance operator unit having a plurality of operating positions to each of which is allocated a unique unit time, said program comprising the steps of:

in response to selection of any one of the operating positions by a human operator, generating time data representative of the unit time allocated to the one operating position; and repetitively generating sound-generation instructing information of the given drum tone color at intervals of the unit time represented by the time data generated by said performance operator unit.

* * * * *